US011735351B2

(12) United States Patent
Takeuchi

(10) Patent No.: US 11,735,351 B2
(45) Date of Patent: Aug. 22, 2023

(54) MAGNETIC COUPLING REACTOR APPARATUS

(71) Applicant: SUMIDA CORPORATION, Tokyo (JP)

(72) Inventor: Akira Takeuchi, Natori (JP)

(73) Assignee: SUMIDA CORPORATION, Tokyo (JP)

( * ) Notice: Subject to any disclaimer, the term of this patent is extended or adjusted under 35 U.S.C. 154(b) by 436 days.

(21) Appl. No.: 16/924,687

(22) Filed: Jul. 9, 2020

(65) Prior Publication Data

US 2021/0020351 A1 Jan. 21, 2021

(30) Foreign Application Priority Data

Jul. 19, 2019 (JP) ..... 2019-134174

(51) Int. Cl.

| | |
|---|---|
| ***H01F 27/26*** | (2006.01) |
| ***H01F 41/064*** | (2016.01) |
| ***H01F 27/28*** | (2006.01) |
| ***H01F 41/02*** | (2006.01) |

(52) U.S. Cl.

CPC ..... *H01F 27/26* (2013.01); *H01F 27/2823* (2013.01); *H01F 41/0246* (2013.01); *H01F 41/064* (2016.01)

(58) Field of Classification Search

CPC .... H01F 27/26; H01F 27/2663; H01F 27/306; H01F 27/2823; H01F 27/24; H01F 27/30

See application file for complete search history.

(56) References Cited

U.S. PATENT DOCUMENTS

| | | | | |
|---|---|---|---|---|
| 2,485,599 | A * | 10/1949 | Halvorsen | H01F 27/263 336/178 |
| 3,332,049 | A * | 7/1967 | Takao | H01F 27/00 336/84 R |
| 6,927,667 | B1 * | 8/2005 | Busletta | H01F 17/045 336/182 |
| 7,078,997 | B2 * | 7/2006 | Toyomura | H01F 30/06 336/192 |
| 9,666,355 | B1 * | 5/2017 | Folker | H01F 27/33 |
| 9,799,442 | B1 * | 10/2017 | Folker | H01F 41/0206 |

(Continued)

FOREIGN PATENT DOCUMENTS

| | | | |
|---|---|---|---|
| CN | 1731543 | * | 8/2006 |
| EP | 1 879 200 | A1 | 1/2008 |

(Continued)

OTHER PUBLICATIONS

English-language translation of JP 2016-066751, published Apr. 28, 2016.

(Continued)

*Primary Examiner* — Marlon T Fletcher
*Assistant Examiner* — Matthew T Sarles
(74) *Attorney, Agent, or Firm* — Oliff PLC

(57) ABSTRACT

A pair of iron-based E-shaped cores is arranged so that middle leg core parts of respective E-shaped cores are disposed opposite each other, and coils are respectively attached to the middle leg core parts in a winding state. A cross-sectional area of the middle leg core part orthogonal to an extending direction thereof and a cross-sectional area of an outer leg core part orthogonal to an extending direction thereof have a specified relationship.

13 Claims, 9 Drawing Sheets

(56) References Cited

U.S. PATENT DOCUMENTS

| | | | | |
|---|---|---|---|---|
| 9,837,194 | B1 * | 12/2017 | Folker | H01F 27/325 |
| 2005/0278940 | A1 * | 12/2005 | Wu | H01F 41/068 29/605 |
| 2007/0057756 | A1 * | 3/2007 | Yang | H01F 17/043 336/212 |
| 2009/0036939 | A1 * | 2/2009 | Singh | H01F 17/043 607/5 |
| 2015/0035636 | A1 * | 2/2015 | Nakatsu | H01F 27/306 335/297 |
| 2015/0102893 | A1 * | 4/2015 | Kawashima | H01F 27/2823 336/212 |
| 2015/0194256 | A1 | 7/2015 | Takagi et al. | |
| 2015/0287512 | A1 * | 10/2015 | Winkler | H01F 27/28 336/212 |
| 2015/0302968 | A1 * | 10/2015 | Lin | H01F 27/24 336/83 |
| 2015/0302969 | A1 * | 10/2015 | Aaron | H01F 41/064 716/112 |
| 2015/0318098 | A1 * | 11/2015 | Miyamoto | H01F 30/00 336/183 |
| 2015/0325354 | A1 * | 11/2015 | Sasaki | H01F 41/02 29/606 |
| 2016/0148748 | A1 * | 5/2016 | Shen | H01F 17/062 29/605 |
| 2017/0164480 | A1 * | 6/2017 | Liu | H05K 1/182 |
| 2018/0075964 | A1 * | 3/2018 | Suzuki | H01F 27/263 |
| 2018/0233281 | A1 * | 8/2018 | Yamaguchi | H01F 41/12 |
| 2018/0286573 | A1 * | 10/2018 | Miyazaki | H01F 27/2847 |
| 2018/0286580 | A1 * | 10/2018 | Tanahashi | H01F 41/02 |
| 2018/0301276 | A1 * | 10/2018 | Yeh | H01F 27/292 |
| 2018/0350493 | A1 * | 12/2018 | Khananashvili | H01F 27/255 |
| 2019/0096571 | A1 * | 3/2019 | Zhang | H01F 27/346 |
| 2019/0122814 | A1 * | 4/2019 | Hung | H01F 27/24 |
| 2019/0131052 | A1 * | 5/2019 | Kusawake | H01F 27/022 |

FOREIGN PATENT DOCUMENTS

| | | | | | |
|---|---|---|---|---|---|
| JP | S61-144626 | U | | 9/1986 | |
| JP | H03-150810 | A | | 6/1991 | |
| JP | H09-045550 | A | | 2/1997 | |
| JP | 6106646 | | * | 3/2010 | H01F 37/00 |
| JP | 2015-115434 | A | | 6/2015 | |
| JP | 2016-009764 | A | | 1/2016 | |
| JP | 2016-066751 | A | | 4/2016 | |
| JP | 2017-050334 | A | | 3/2017 | |
| JP | 6106646 | B2 | | 4/2017 | |
| JP | 2018-026467 | A | | 2/2018 | |
| JP | 2018-107325 | | * | 7/2018 | H01F 37/00 |
| JP | 2018-133499 | A | | 8/2018 | |

OTHER PUBLICATIONS

Aug. 19, 2020 Extended Search Report Issued in European Patent Application No. 20181317.7.

Jan. 30, 2023 Office Action issued in Japanese Patent Application No. 2019-134174.

* cited by examiner

MAGNETIC COUPLING REACTOR APPARATUS

RELATED APPLICATION

This invention claims the benefit of Japanese Patent Application No. 2019-134174 filed on Jul. 19, 2019, which is hereby incorporated by reference.

BACKGROUND OF THE INVENTION

Field of the Invention

The present invention relates to a magnetic coupling reactor apparatus mounted in, for example, an electric vehicle or a hybrid vehicle and more particularly relates to a magnetic coupling reactor apparatus in which a part of a core thereof forming a magnetic path is inserted through a plurality of coil parts so that the coil parts are magnetically coupled.

Description of the Prior Art

As an in-vehicle magnetic coupling reactor, a magnetic coupling reactor apparatus has been known in which a pair of U-shaped cores thereof abuts against each other at the tips of both leg parts so as to form an annular core part, and each of the U leg parts is wound with a coil part so as to form a total of four coil parts. Furthermore, the magnetic coupling reactor causes two coils to generate magnetic fluxes in mutually canceling directions to prevent magnetic saturation of the cores and reduces the ripple using the mutual inductance, achieving size reduction and high efficiency (see Japanese Patent No. 6106646, for example).

SUMMARY OF THE INVENTION

As described above, a magnetic coupling reactor normally uses a pair of U-shaped cores. This makes it difficult to increase the degree of coupling (coupling coefficient), which is a key parameter for low ripple, and tends to increase magnetic leakage. Furthermore, when the degree of coupling is low, the direct current superposition characteristics unfortunately tend to deteriorate.

The present invention has been made in view of the above circumstances and has an object to provide a magnetic coupling reactor apparatus having an increased degree of coupling over the conventional art, reducing magnetic leakage and enhancing the direct current superposition characteristics.

To solve the above problems, the magnetic coupling reactor apparatus according to the present invention includes at least one pair of multi-leg core members made of an iron-based material, in which the at least one pair of multi-leg core members includes: a base core part, and three or more leg core parts projecting from the base core part in an identical direction, wherein the at least one pair of multi-leg core members is disposed so that corresponding leg core parts abut against each other, and at least one coil winding leg core part forming, of the corresponding leg core parts, an inner leg core part except for both outer leg core parts includes an abutting portion of the inner leg core part, a coil part being attached in a winding state to each of the leg core parts sandwiching the abutting portion so as to form a magnetic coupling structure, and when a cross-sectional area of the coil winding leg core part orthogonal to an extending direction of the coil winding leg core part is Si, and a cross-sectional area of each of the outer leg core parts orthogonal to an extending direction of the outer leg core parts is So, a conditional expression (1) below holds.

$$1.0 \leq Si/So \leq 5.0 \quad (1)$$

Here, regarding "a cross-sectional area of each of the outer leg core parts," when the cross-sectional areas of the outer leg core parts differ from each other, each of the outer leg core parts needs to satisfy the above expression (1).

A range of the conditional expression (1) is preferably limited to a range of a conditional expression (2) below.

$$1.5 \leq Si/So \leq 3.5 \quad (2)$$

Furthermore, the range of the conditional expression (1) is further preferably limited to a range of a conditional expression (3) below.

$$1.5 \leq Si/So \leq 3.0 \quad (3)$$

The multi-leg core member is preferably made of an E-shaped core member, and one coil part is preferably attached to a middle leg core part forming the coil winding leg core part of the E-shaped core member in a winding state.

Furthermore, the middle leg core part is preferably offset upward at least by a width of the coil part with respect to the outer leg core parts.

An input end of the coil part wound around each of the corresponding coil winding leg core parts of the pair of multi-leg core members is preferably disposed on one side with respect to an axis of the multi-leg core member, and winding directions of the coil parts are preferably reversed to each other.

The input end and an output end of each of the coil parts wound around each of the corresponding coil winding leg core parts of the pair of multi-leg core members are preferably pulled out above an upper end surface of the outer leg core part on one side, and a height of the outer leg core part on the one side is preferably set to be lower by a dimension corresponding to a width of the coil part than a height of the outer leg core part on the other side.

Furthermore, a corner part of the E-shaped core member preferably has a chamfer extending in a thickness direction of the E-shaped core member.

An area of a cross section in a direction orthogonal to an axis of the outer leg core part on one side is preferably formed to be equal to an area of a cross section in a direction orthogonal to an axis of the outer leg core part on the other side, and in the two cross sections, the cross section on the one side is preferably formed to be lower in height and wider in width than the cross section on the other side.

Furthermore, a resin material having a thickness corresponding to a difference in height between the outer leg core part on one side and the outer leg core part on the other side is preferably attached to a portion where an input end and output end of each of the coil parts are not disposed on an upper surface of the outer leg core part on the one side.

Furthermore, the middle leg core part is preferably provided with one or more air gaps.

Furthermore, instead of the middle leg core part or in addition to the middle leg core part, at least one of the outer leg core parts is preferably provided with one or more air gaps.

According to the magnetic coupling reactor apparatus of the present invention, the core part is configured by making the iron-based multi-leg core members abut, and the coil part is disposed at each of the opposing inner legs of the multi-leg core members. Thereby, compared to the magnetic coupling reactor apparatus of the above described Japanese Patent No. 6106646, distances between the coils arranged in the axis directions of the coil parts can be shortened, the degree of coupling can be easily increased, and the rate of magnetic flux leakage can be reduced.

Furthermore, the value of the ratio of the cross-sectional area of the coil winding leg core part with respect to the cross-sectional area of the outer leg core part is set between 1.0 to 5.0. Thereby, the self-inductance can be set to a larger value, and the direct current superposition characteristics can be maintained at a desired value.

Furthermore, the coil part is disposed at each of at least one pair of opposing inner leg core parts of the multi-leg core members. Accordingly, the coil part is surrounded by the magnetic path, significantly reducing magnetic leakage to the outside.

DESCRIPTION OF THE EMBODIMENTS

Embodiment

Figure 1:
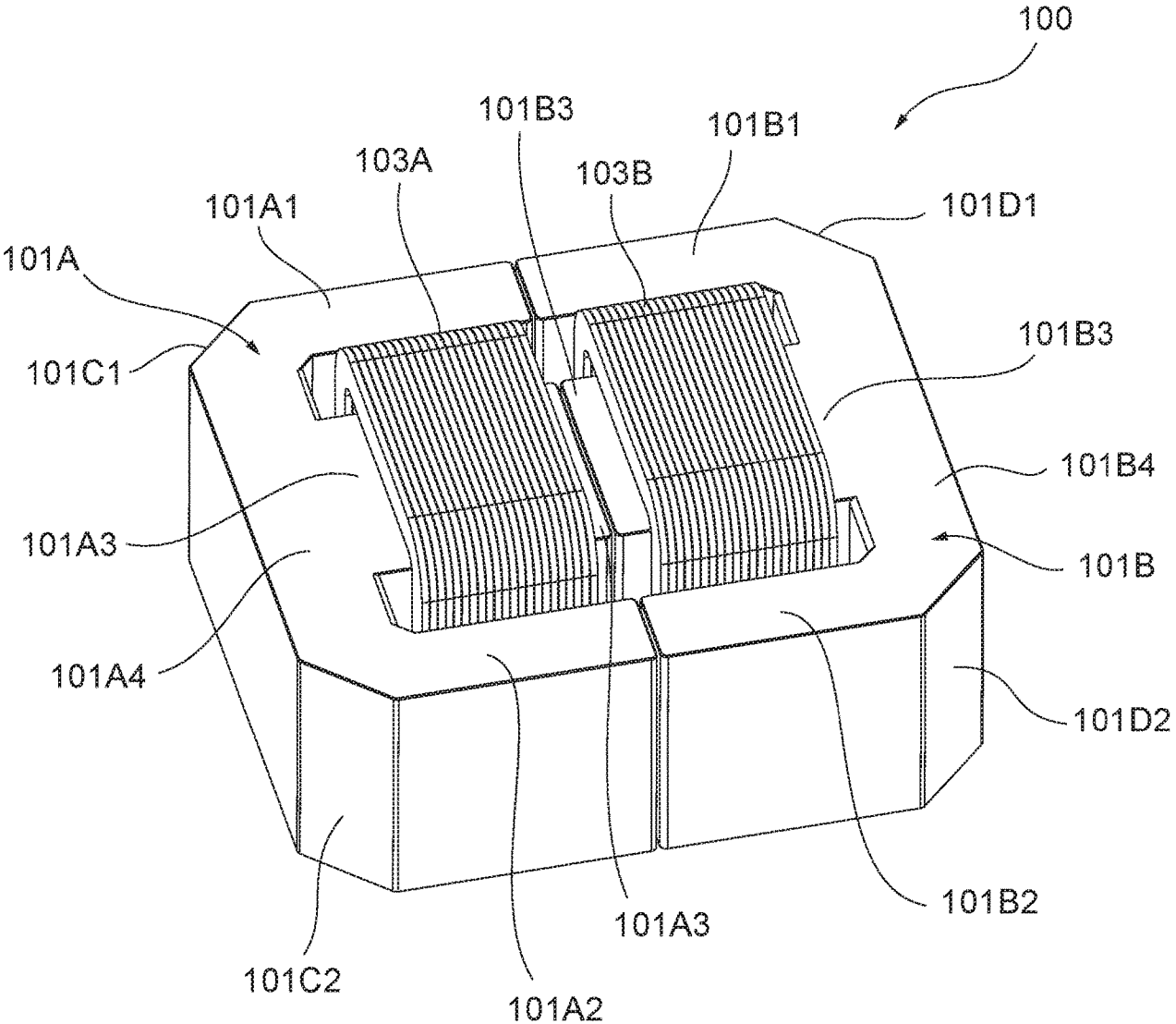
FIG. 1 is a perspective view showing a magnetic coupling reactor apparatus in which only middle leg core parts of E-shaped cores thereof are wound with coil parts, according to the embodiment of the present invention.

Hereinafter, a magnetic coupling reactor apparatus according to the embodiment of the present invention will be explained appropriately using FIG. 1 and other figures. The magnetic coupling reactor apparatus of the present embodiment includes a case 108 made of a material with good heat conductivity such as metal (aluminum or the like) having an upper opening, a reactor body 100 stored inside the case 108, and a filler 110 with insulation properties injected between the case 108 and the reactor body 100.

Furthermore, in the present embodiment, a case will be particularly explained where an E-shaped core having three leg parts disposed so as to project perpendicularly from a base core part (a yoke part hereinafter simply referred to as a base core part) is used.

<Main Configuration of Magnetic Coupling Reactor Apparatus>

<Core Part>

Figure 2:
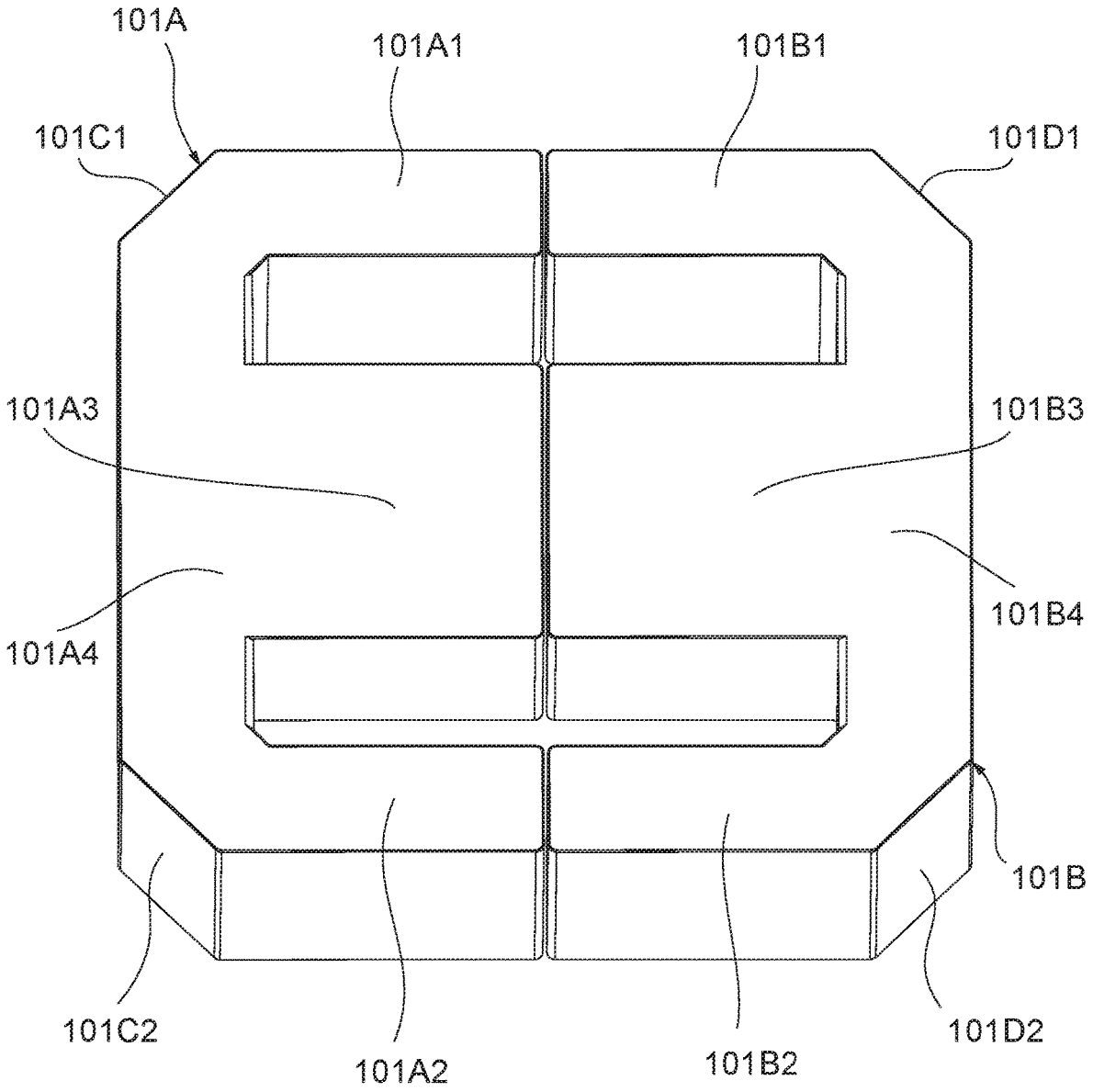
FIG. 2 is a perspective view showing only a core part of the magnetic coupling reactor apparatus shown in FIG. 1.

A magnetic coupling reactor apparatus 200 according to the embodiment of the present invention is configured to be a magnetic coupling type. As shown in FIGS. 1 and 2, a main part thereof includes a pair of E-shaped cores 101A and 101B. The pair of E-shaped cores 101A and 101B is disposed so that tips of leg parts (both outer leg core parts 101A1 and 101A2, a middle leg core part 101A3, both outer leg core parts 101B1 and 101B2, and a middle leg core part 101B3) projecting perpendicularly from respective base core parts 101A4 and 101B4 face each other, forming a θ-shaped core part as shown in FIG. 2. Furthermore, the middle leg core parts 101A3 and 101B3 are respectively wound with coils 103A and 103B.

Furthermore, corner parts of the E-shaped core 101A are chamfered to form shoulder parts 101C1 and 101C2, and corner parts of the E-shaped core 101B are chamfered to form shoulder parts 101D1 and 101D2. That is, since magnetic fluxes hardly flow through such corner parts, the corner part is chamfered to remove its corner portion, making the entire core compact.

Furthermore, a core member constituting the core part is made of an iron material. Using an iron-based material can achieve high magnetic density and set a high degree of coupling that tends to decrease by the present structure. As an iron-based material, an electromagnetic steel sheet, a powder magnetic core (pure iron, Fe—Si-AL-based alloy, Ni—Fe—Mo-based alloy, or Ni—Fe-based alloy), amorphous, or the like can be used.

Furthermore, although the tips of the E-shaped cores 101A and 101B may directly abut, a spacer may intervene between both tips, or an air gap may be provided therebetween.

<Coil>

Furthermore, the coils 103A and 103B are formed by winding the rectangular wires edgewise. As shown in FIG. 1 and the like, the rectangular wire is a belt-shaped flat conductive wire, and one having, for example, a thickness of 0.5 to 6.0 mm and a width of 1.0 to 16.0 mm is typically used. Using the rectangular wire can improve the space factor, achieving size reduction and enhancing the skin effect. Alternatively, one having a different cross-sectional shape such as a round wire or a square wire may be used.

The two coils 103A and 103B are wound so that direct current magnetic fluxes generated therefrom cancel each other out (this will be described later). The coils 103A and 103B are cylindrically wound in advance and, when stored in the case 108, respectively fitted to the middle leg core part 101A3 of the E-shaped core 101A and the middle leg core part 101B3 of the E-shaped core 101B, combining with the core part.

That is, when a current flows from one end of the coil 103A to the other end, and a current flows from one end of the coil 103B to the other end, the magnetic flux flowing in the middle leg core part 101A3 and the magnetic flux flowing in the middle leg core part 101B3 flow in the opposite directions, so that the magnetic fluxes passing through the two middle leg core parts 101A3 and 101B3 are canceled out. This forms a magnetic flux loop circulating through the cores 101A and 101B in order of the base core part 101A4, the outer leg core part 101A1, the outer leg core part 101B1, the base core part 101B4, the outer leg core part 101B2, the outer leg core part 101A2, and the base core part 101A4.

The two coil parts 103A and 103B form a two-phase reactor apparatus, achieving size reduction in the apparatus compared to a case where two one-phase reactor apparatuses are provided.

Furthermore, the middle leg core part 101A3 of the E-shaped core 101A and the middle leg core part 101B3 of the E-shaped core 101B are respectively provided with the coil parts 103A and 103B. This allows the entire apparatus to have a symmetric shape, achieving efficient magnetic coupling.

<Resin Molded Body>

The E-shaped cores 101A and 101B are respectively stored in a state of being embedded in resin molded bodies (including bobbins of the coils 103A and 103B and covers of the cores 101A and 101B) 105A and 105B, and in this state, resin is filled in the mold. Thereby, the E-shaped cores 101A and 101B are formed integrally with the resin molded bodies 105A and 105B. The resin molded body 105A insulates the E-shaped core 101A from the coil 103A by intervening therebetween, and the resin molded body 105B insulates the E-shaped core 101B from the coil 103B by intervening therebetween. As a resin molding material, for example, unsaturated polyester-based resin, urethane resin, epoxy resin, PBT (polybutylene terephthalate), PPS (polyphenylene sulfide), or the like and the resin molding material to which glass and a heat conductive filler are added can be used.

<Magnetic Coupling Reactor Apparatus>

Figure 3:
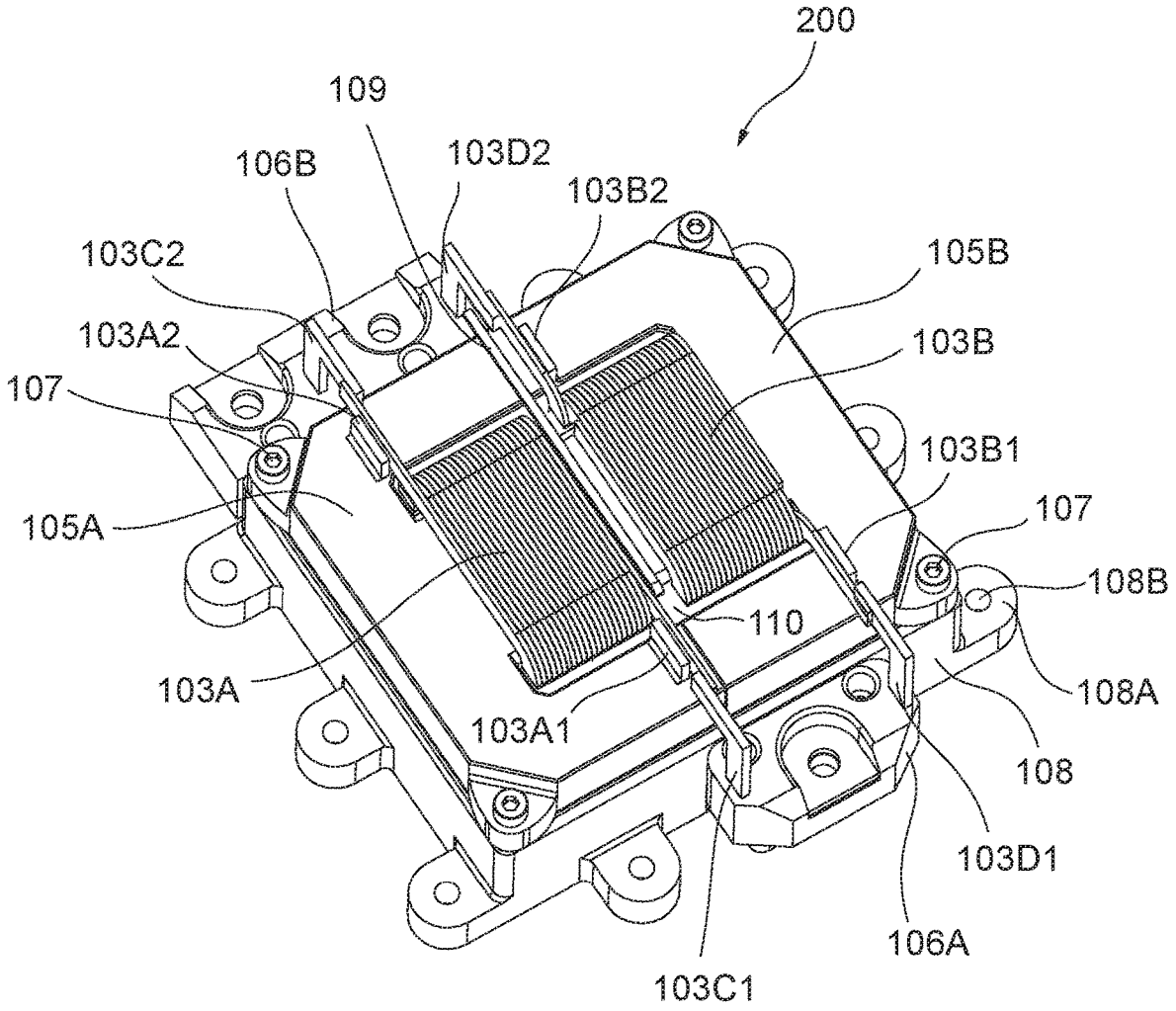
FIG. 3 is a perspective view showing an exterior of the magnetic coupling reactor apparatus of the present invention.

FIG. 3 is a schematic perspective view of the magnetic coupling reactor apparatus according to the present embodiment. The magnetic coupling reactor apparatus 200 is fixed by a screw to a base part (not shown) on which the magnetic coupling reactor apparatus 200 is mounted. That is, the case 108 made of metal such as aluminum includes screw fastening parts 108A on four sides thereof. A screw (not shown) is screwed into the base part via a screw hole 108B of the screw fastening part 108A, so that the magnetic coupling reactor apparatus 200 can be mounted on the base part. Although the tips of the above described E-shaped cores 101A and 101B may directly abut, a spacer may intervene therebetween, or one or more air gaps may be provided therebetween. That is, one or more air gaps may be provided at the middle leg core parts 101A3 and 101B3, and instead of this or in addition to this, one or more air gaps may be provided at the outer leg core parts 101A1, 101A2, 101B1, and 101B2. Here, "one or more air gaps may be provided" refers to a case where the core part is divided into a plurality of parts, and a space is provided between the divided core parts, or a non-magnetic material (for example, PET [polyethylene terephthalate], phenol resin, or the above described resin molding material) is filled between these core parts.

Furthermore, the case 108 stores the reactor body in which the E-shaped cores 101A and 101B are respectively combined with the coils 103A and 103B. The resin molded body (bobbin) 105A can insulate the E-shaped core 101A from the coil 103A by intervening therebetween, and the resin molded body (bobbin) 105B can insulate the E-shaped core 101B from the coil 103B by intervening therebetween. Furthermore, the reactor body is restrained from above so as to be fixed inside the case 108. The resin molded body (bobbin) is fixed to the case 108 by a bolt 107.

Furthermore, the case 108 is provided with terminal blocks 106A and 106B made of resin at two positions. The terminal block 106A supports a metal terminal 103C1 connected to an input end 103A1 of the coil 103A and a metal terminal 103D1 connected to an input end 103B1 of the coil 103B. The terminal block 106B supports a metal terminal 103C2 connected to an output end 103A2 of the coil 103A and a metal terminal 103D2 connected to an output end 103B2 of the coil 103B.

Furthermore, the case 108 is provided with a thermistor 109 that measures temperature of the reactor body and the filler 110 that fills a gap inside the case 108 to achieve uniform heat distribution. The filler 110 can be used by solidifying a liquid or gel material made of, for example, urethane resin, epoxy resin, acrylic resin, silicone resin, or the like and the filler to which a heat conductive filler is added.

By the way, in the present embodiment, the ratio of a cross-sectional area of the middle leg core part 101A3 with respect to the outer leg core parts 101A1 and 101A2 is specified within a predetermined range, increasing the self-inductance and improving the direct current superposition characteristics.

Figure 4:
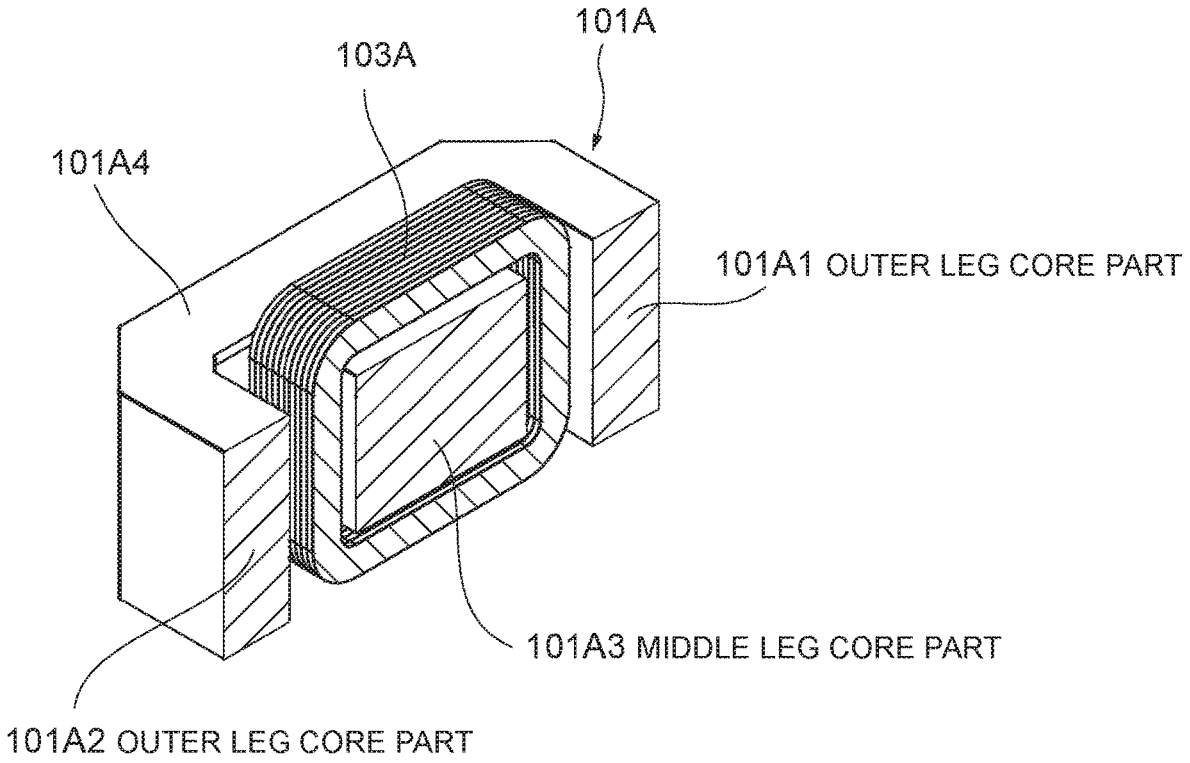
FIG. 4 is a perspective view showing a cross-sectional shape of the core of the magnetic coupling reactor apparatus shown in FIG. 1.

That is, according to the cross-sectional view of the reactor body as shown in, for example, FIG. 4, a center part thereof is provided with the middle leg core part 101A3 wound with the coil part 103A, and both sides of the middle leg core part 101A3 are respectively provided with the outer leg core parts 101A1 and 101A2.

Here, when the cross-sectional area of the middle leg core part 101A3 is Si, and a cross-sectional area of the outer leg core part 101A1 or 101A2 (either one of the cross-sectional areas of the outer leg core parts 101A1 and 101A2) is So, a conditional expression (1) below holds. The cross section here indicates a cross section in a direction orthogonal to an axis of each leg part.

$$1.0 \leq Si/So \leq 5.0 \quad (1)$$

Figure 5:
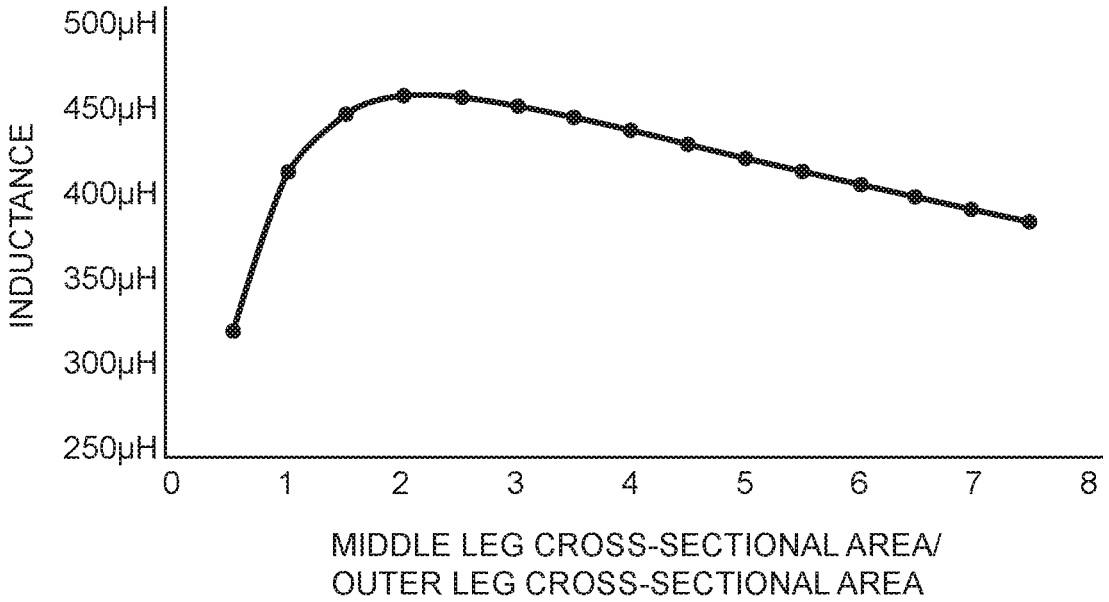
FIG. 5 is a plotted graph showing changes in inductance with respect to a value of a cross-sectional area of the middle leg core part over a cross-sectional area of an outer leg core part.

FIG. 5 is a graph showing changes in inductance (μH) with respect to the value of Si/So (in FIG. 5, described as middle leg cross-sectional area/outer leg cross-sectional area). According to FIG. 5, the value of Si/So is maximized in the vicinity of 2 to 2.5, and when it is less than 1, the value of inductance sharply decreases.

In the present embodiment, the lower limit of Si/So is 1.0, and the upper limit thereof is 5.0. Thus, the inductance can be about 400 μH or more, and the self-inductance can be a relatively large value. Furthermore, the magnetic coupling reactor apparatus can be configured so as to further improve the direct current superposition characteristics.

Instead of the conditional expression (1), a conditional expression (2) below is further desirable.

$$1.5 \leq Si/So \leq 3.5 \quad (2)$$

In this way, when the lower limit of Si/So is set to be 1.5 and the upper limit thereof is set to be 3.5, the inductance can be about 450 μH or more, and the self-inductance can be a larger value. Furthermore, the magnetic coupling reactor apparatus can be configured so as to further improve the direct current superposition characteristics.

Furthermore, instead of the conditional expression (2), a conditional expression (3) below is further desirable.

$$1.5 \leq Si/So \leq 3.0 \quad (3)$$

In this way, when the lower limit of Si/So is set to be 1.5 and the upper limit thereof is set to be 3.0, the inductance can be 450 μH or more, and the self-inductance can be a larger value. Furthermore, the direct current superposition characteristics can be further improved.

A core shape in the magnetic coupling reactor apparatus of the present embodiment according to a modified example for promoting reduction in height will be explained using FIG. 6.

Figure 6:
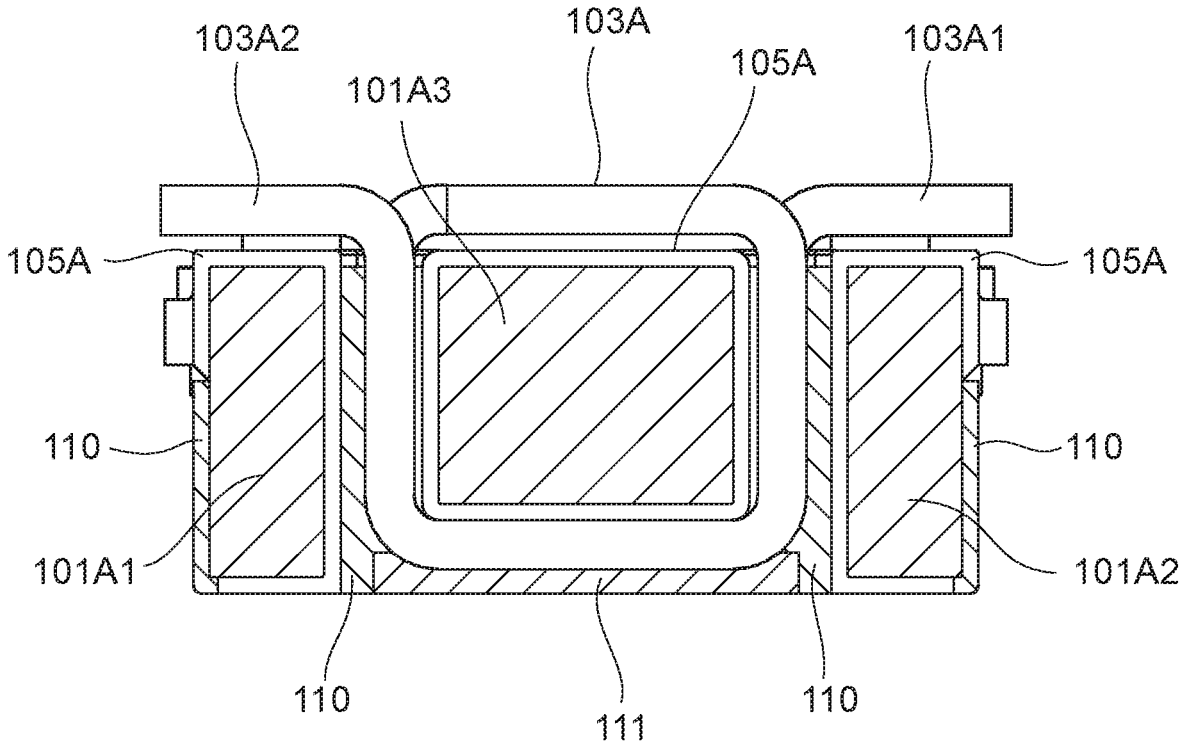
FIG. 6 is a cross-sectional view showing a state where the middle leg core part is offset with respect to the outer leg core part.

That is, according to the cross-sectional view of the reactor body as shown in FIG. 6, the center part thereof is provided with the middle leg core part 101A3 wound with the coil part 103A, and both sides of the middle leg core part 101A3 are respectively provided with the outer leg core parts 101A1 and 101A2. The filler 110 is injected between the members.

In this modified example, as shown in FIG. 6, the input end 103A1 and the output end 103A2 are pulled out from the wound coil 103A in the lateral direction in the figure. The pulled-out input end 103A1 is placed on the bobbin 105A above the outer leg core part 101A2, and the pulled-out output end 103A2 is placed on the bobbin 105A above the outer leg core part 101A1. In this way, the height of the coil 103A in FIG. 6 becomes the smallest when an upper side of the winding part is aligned with the pulled-out input end 103A1 and the pulled-out output end 103A2.

Accordingly, in this modified example, the middle leg core part 101A3 is disposed so as to be offset upward with respect to the outer leg core parts 101A1 and 101A2. The middle leg core part 101A3 thereby fits within a hollow part of the coil 103A, ensuring reduction in height of the reactor body.

In FIG. 6, a heat conductive member 111 is disposed between a lower surface of the coil 103A and a heat sink, which is not shown. The coil 103A is placed on the heat conductive member 111. Thereby, a member surface abutting against the heat sink can be flat. This improves heat conduction efficiency with respect to the heat sink, resulting in improved heat dissipation.

The offset amount of the middle leg core part 101A3 is obtained by adding the width of the coil 103A to the distance for ensuring insulation and a, which is the sum of the assembly margins.

An aspect of the magnetic coupling reactor apparatus of the present embodiment for enhancing the freedom in layout of the terminal part will be explained.

As shown in FIG. 3, the terminal block 106A of the magnetic coupling reactor apparatus 200 is provided with end connection parts 103C1 and 103D1. A current from the end connection part 103C1 is input from the input end 103A1 of the coil into the coil 103A, and a current from the end connection part 103D1 is input from the input end 103B1 of the coil into the coil 103B. That is, current input ends of the two coils 103A and 103B are respectively positioned at one sides of the coils 103A and 103B. On the other hand, the terminal block 106B is provided with the end connection parts 103C2 and 103D2. A current from the coil 103A is output via the output end 103A2 to the end connection part 103C2, and a current from the coil 103B is output via the output end 103B2 to the end connection part 103D2. That is, current output ends of the two coils 103A and 103B are respectively aligned so as to be positioned at the other sides of the coils 103A and 103B opposite to the current input parts.

In this way, the positions of the input ends of the two coils 103A and 103B are aligned, and the positions of the output ends thereof are aligned. This improves efficiency of, for example, design around the terminal part. Additionally, magnetic fluxes penetrating the coils 103A and 103B when currents flow thereto need to flow in the opposite directions so as to be canceled out. Accordingly, the winding directions of the coils 103A and 103B are reversed to each other between the two coils 103A and 103B.

This reduces loss in the wiring, enhances the freedom in layout of the terminal part, and achieves reduction in height.

Furthermore, a core shape in the magnetic coupling reactor apparatus of the present embodiment according to the other modified example for promoting reduction in height will be explained using FIG. 7.

Figure 7:
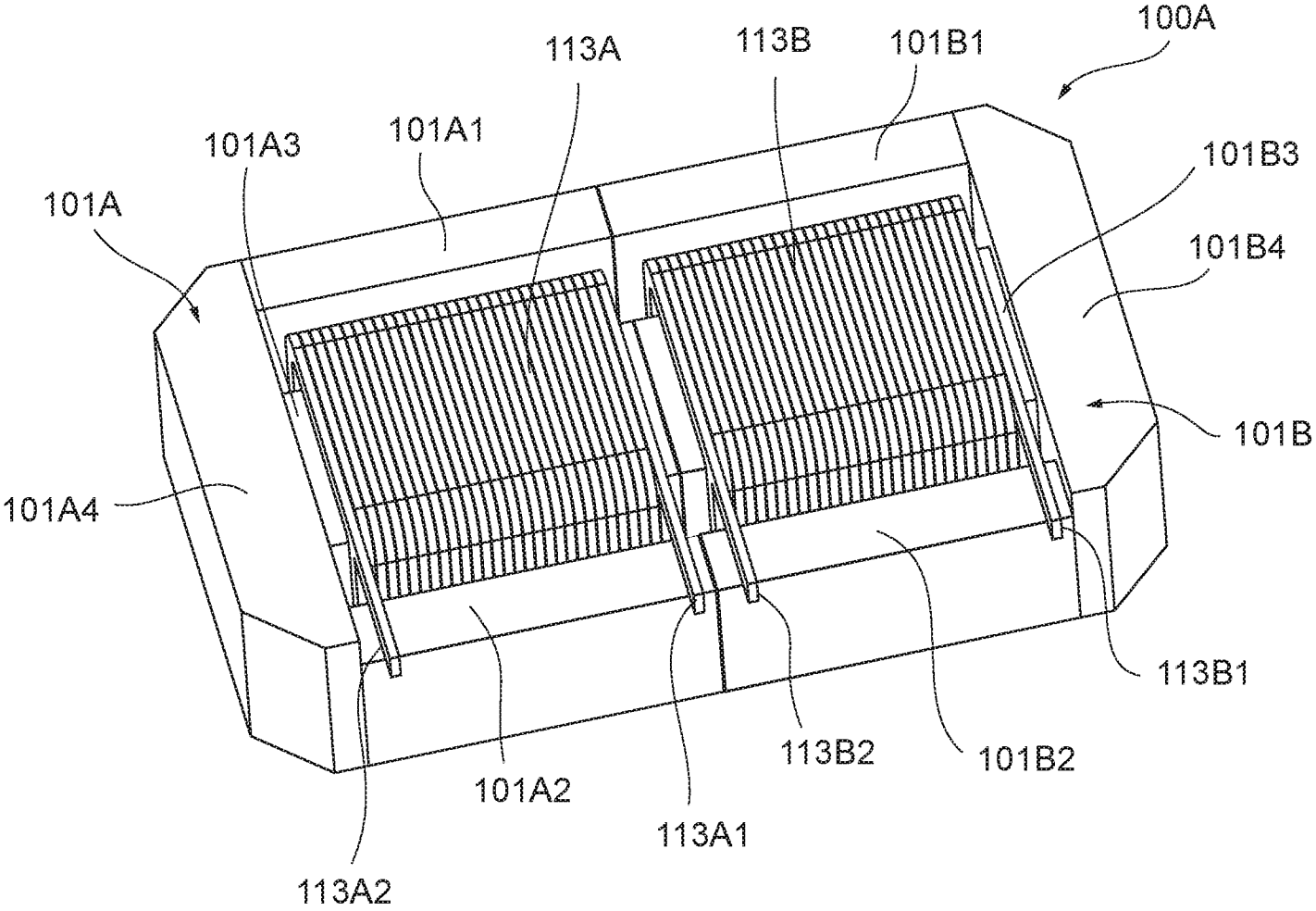
FIG. 7 is a perspective view showing a state where both outer leg core parts have different heights.

In the modified example shown in FIG. 7, similarly to the reactor body 100 of the magnetic coupling reactor apparatus 200 shown in FIG. 3, a reactor body 100A includes the pair of E-shaped cores 101A and 101B and the pair of coils 103A and 103B. On the other hand, in the reactor body 100A, an input end 113A1 and output end 113A2 of a coil 113A are all pulled out to one side of the coil 103A, and an input end 113B1 and output end 113B2 of a coil 113B are all pulled out to one side of the coil 103B. The height of the outer leg core part 101A2 on the side from which the coil 103A is pulled out is formed to be lower by the width of the coil 113A than the heights of the outer leg core part 101A1 on the other side and the base core part 101A4. The height of the outer leg core part 101B2 on the side from which the coil 103B is pulled out is formed to be lower by the width of the coil 113B than the heights of the outer leg core part 101B1 on the other side and the base core part 101B4. This enhances the self-inductance and reduces loss in the wiring.

Figure 8:
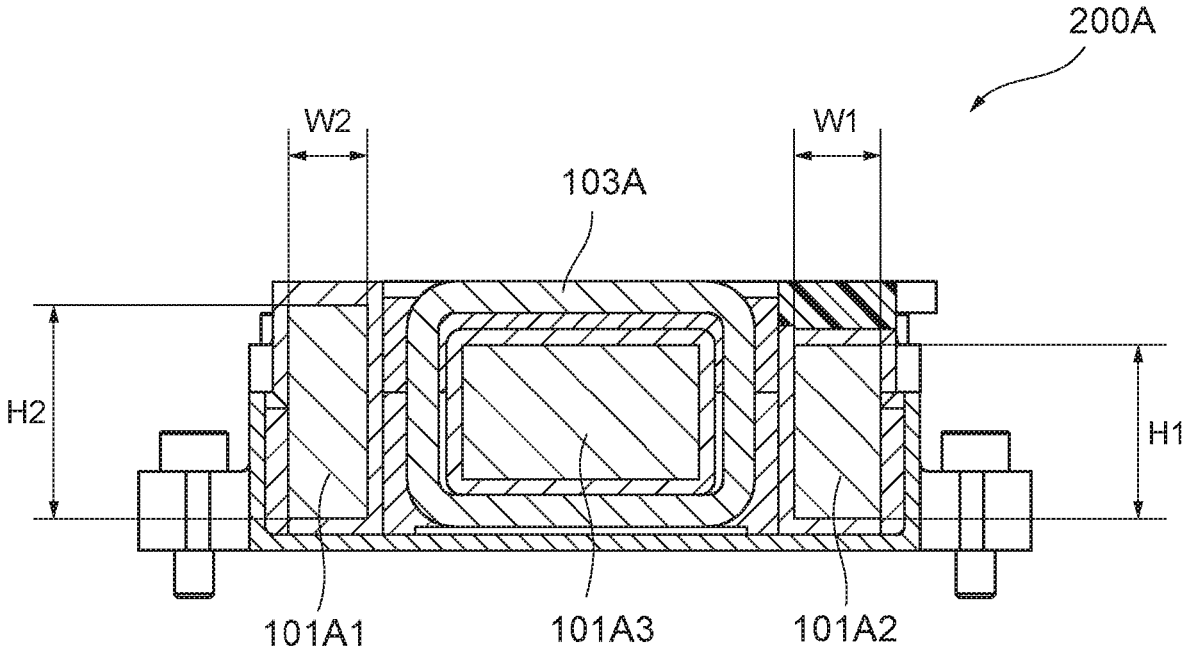
FIG. 8 is a cross-sectional view showing differences in height and width between the outer leg core parts.

As described above, the cross-sectional areas of the outer leg core parts 101A2 and 101B2 on one side (wiring lead-out side) are desirably formed to be equal to those of the outer leg core parts 101A1 and 101B1 on the other side, respectively. As above, to respectively equalize the cross-sectional areas of the outer leg core parts 101A2 and 101B2 on one side and the outer leg core parts 101A1 and 101B1 on the other side as a result of creating differences in height between the outer leg core part 101A2 and the outer leg core part 101A1 and between the outer leg core part 101B2 and the outer leg core part 101B1, the lateral widths of the outer leg core parts 101A2 and 101B2 on one side (wiring lead-out side) are respectively made longer than those of the outer leg core parts 101A1 and 101B1 on the other side, as shown in a magnetic coupling reactor apparatus 200A in FIG. 8. That is, when the heights of the outer leg core parts 101A2 and 101B2 are H1 and the lateral widths thereof are W1, and the heights of the outer leg core parts 101A1 and 101B1 are H2 and the lateral widths thereof are W2, the lateral widths W1 and W2 are adjusted so that an equation of $H1 \times W1 = H2 \times W2$ holds. This reduces the size of the entire reactor body 100A.

Furthermore, as above, when the heights of the outer leg core parts 101A2 and 101B2 on the side from which the coils 103A and 103B are pulled out are lowered, the filler 110 filled for a heat dissipation effect may only be filled to the heights of the outer leg core parts 101A2 and 101B2.

Figure 9:
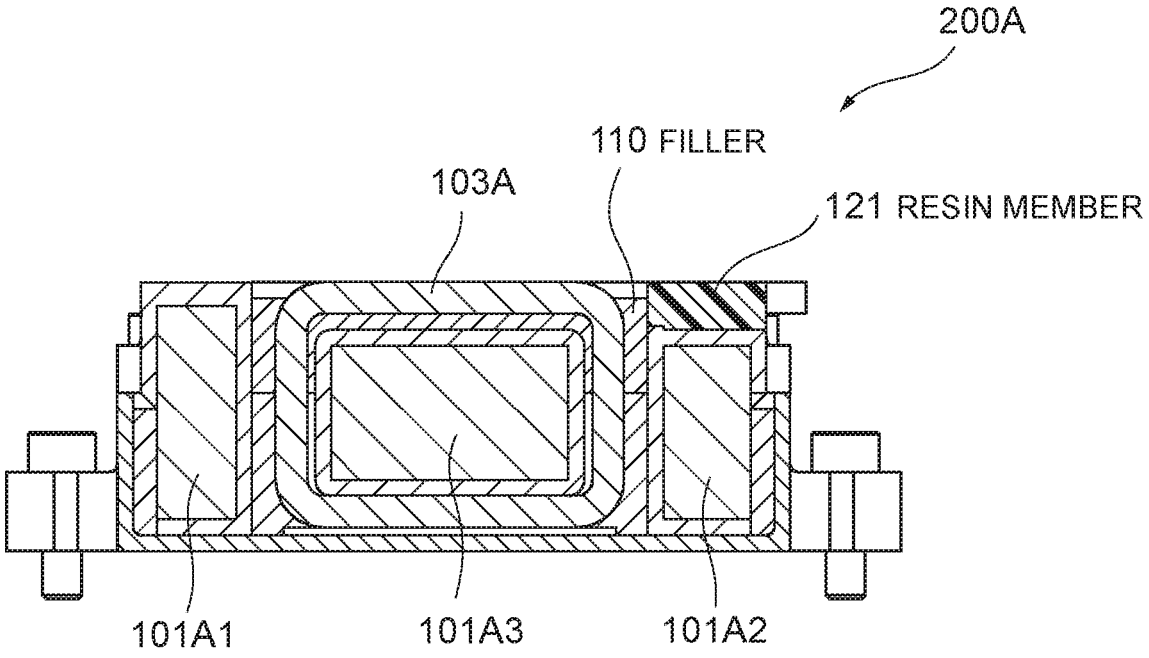
FIG. 9 is a cross-sectional view showing a state where a resin member is disposed at a predetermined position to reduce the influence of the difference in height between the outer leg core parts.

Accordingly, as shown in FIG. 9, a resin member 121 made of a material different from the filler 110 is disposed at upper regions of the outer leg core parts 101A2 and 101B2 so that the heights of the outer leg core parts 101A2 and 101B2 including the resin member 121 are approximately the same as those of the outer leg core parts 101A1 and 101B1. Thus, the filler 110 can be filled to the heights of the outer leg core parts 101A1 and 101B1. This improves heat dissipation performance.

The resin member 121 is desirably a flowable material for facilitating the filling, and more desirably an inexpensive insulative material. Suitable examples of the specific material include phenol resin and PPS (polyphenylene sulfide resin).

In the assembly process of the magnetic coupling reactor apparatus of the present embodiment, the coil parts 103A and 103B are cylindrically formed in advance, and the E-shaped cores 101A and 101B are respectively inserted into the hollow parts of the coils 103A and 103B. Thereby, the coils 103A and 103B are formed to be respectively wound around the E-shaped cores 101A and 101B.

The magnetic coupling reactor apparatus of the present invention is not limited to the above embodiment and can be modified in various ways.

For example, although in the magnetic coupling reactor apparatus of the above described embodiment, the core part is formed by combining two E-shaped cores whose three leg core parts project from the base core part, the magnetic coupling reactor apparatus of the present invention, not limited to this, can include any number of two or more multi-leg core members whose any number of four or more leg core parts project from the base core part.

Furthermore, when the multi-leg core member whose four or more leg core parts project from the base core part is used, any of middle leg core parts can be wound. Furthermore, each multi-leg core member can include any polyphase having two or more phases.

Furthermore, a cross-sectional shape of the multi-leg core member may not be rectangular and may be another shape such as a circle or an ellipse.

In the above, although one coil is provided for the middle leg core part of each E-shaped core, any number of coils may be provided for the individual middle leg core parts 101A3 and 101B3. Note that it is preferable that a symmetrical form is configured as a whole.

Furthermore, as described above, the two coil parts 103A and 103B are wound in directions in which the generating magnetic fluxes in the middle leg core parts 101A3 and 101B3 cancel each other out. Accordingly, it is preferable that the directions of the currents supplied to both coil parts are the same, and the rectangular wires are wound in the opposite directions as described above. Additionally, the directions of the currents supplied to both coils 103A and 103B are reversed, and the rectangular wires are wound in the identical direction, thereby obtaining a function in which the magnetic fluxes generated in the coils 103A and 103B cancel each other out.

What is claimed is:

1. A magnetic coupling reactor apparatus comprising at least one pair of multi-leg core members made of an iron-based material, each of the multi-leg core members comprising:

a base core part;

three or more leg core parts projecting from the base core part in an extending direction, the three or more leg core parts including outer leg core parts and at least one inner leg core part disposed between outer leg core parts; and a coil part being attached in a winding state to the at least one inner leg core part, wherein the multi-leg core members of the at least one pair of multi-leg core members are arranged so that corresponding leg core parts from each multi-leg core member are disposed opposite each other in the extending direction, and so that the coil parts of the respective at least one inner leg core parts are disposed opposite of each so as to form a magnetic coupling structure, the following expression (1) is satisfied:

$$1.0 \leq Si/So \leq 5.0 \quad (1)$$

where Si is a cross-sectional area of the at least one inner leg core part in a direction orthogonal to the extending direction, and So is a cross-sectional area of either of the outer leg core parts in a direction orthogonal to the extending direction, and an input end and an output end of each of the coil parts wound around the respective at least one inner leg core parts of the pair of multi-leg core members extend above an upper end surface of the outer leg core part on one side, and a height of the outer leg core part on the one side is less than a height of the outer leg core part on the other side by a width of the coil part.

2. The magnetic coupling reactor apparatus according to claim 1, wherein the following expression (2) is satisfied:

$$1.5 \leq Si/So \leq 3.5 \quad (2).$$

3. The magnetic coupling reactor apparatus according to claim 1, wherein the following expression (3) is satisfied:

$$1.5 \leq Si/So \leq 3.0 \quad (3).$$

4. The magnetic coupling reactor apparatus according to claim 1, wherein each multi-leg core member is an E-shaped core member, and in each multi-leg core member:

the at least one inner leg core part is a middle leg core part of the E-shaped core member.

5. The magnetic coupling reactor apparatus according to claim 4, wherein a corner part of the E-shaped core member includes a chamfer extending in a thickness direction of the E-shaped core member.

6. The magnetic coupling reactor apparatus according to claim 1, wherein an input end of the coil part wound around each of the corresponding at least one inner leg core parts of the pair of multi-leg core members is disposed on one side with respect to an axis of the respective multi-leg core member, and winding directions of the respective coil parts are reversed relative to each other.

7. The magnetic coupling reactor apparatus according to claim 1, wherein the area of the cross section in the direction orthogonal to the extending direction of the outer leg core part on one side of the at least one inner leg core part is equal to the area of the cross section in the direction orthogonal to the extending direction of the outer leg core part on the other side of the at least one inner leg core part, and in the two cross sections, the cross section on the one side is lower in height and wider in width than the cross section on the other side.

8. The magnetic coupling reactor apparatus according to claim 1, wherein a resin material having a thickness corresponding to a difference in height between the outer leg core part on one side of the at least one inner leg core part and the outer leg core part on the other side of the at least one inner leg core part is attached to a portion where an input end and output end of each of the coil parts are not disposed on an upper surface of the outer leg core part on the one side.

9. The magnetic coupling reactor apparatus according to claim 4, wherein the middle leg core part includes one or more air gaps.

10. The magnetic coupling reactor apparatus according to claim 4, wherein at least one of the outer leg core parts includes one or more air gaps.

11. The magnetic coupling reactor apparatus according to claim 1, wherein the corresponding leg core parts from each multi-leg core member that are disposed opposite each other in the extending direction abut against each other in the extending direction.

12. The magnetic coupling reactor apparatus according to claim 1, wherein the corresponding leg core parts from each multi-leg core member that are disposed opposite each other in the extending direction are separated by a gap in the extending direction.

13. The magnetic coupling reactor apparatus according to claim 1, wherein a center of the at least one inner leg core part in a height direction orthogonal to the extending direction is offset upward by at least the width of the coil part with respect to a center of the outer leg core parts in the height direction orthogonal to the extending direction.

* * * * *